US005826879A

United States Patent [19]

Spector

[11] Patent Number: 5,826,879

[45] Date of Patent: Oct. 27, 1998

[54] SHOOTER AND FABRIC TARGET WATER GUN GAME

[76] Inventor: Donald Spector, 380 Mountain Rd., Union City, N.J. 07087

[21] Appl. No.: 27,923

[22] Filed: Feb. 23, 1998

[51] Int. Cl.[6] ..... A63B 67/00; F41J 5/00

[52] U.S. Cl. ..... 273/349

[58] Field of Search ..... 273/349

[56] References Cited

U.S. PATENT DOCUMENTS 4,586,715 5/1986 Scolari et al. ..... 463/50

4,743,030 5/1988 Auer et al. ..... 273/349

*Primary Examiner*—William H. Grieb

*Attorney, Agent, or Firm*—Michael Ebert

[57] ABSTRACT

A mock battle game for children in which each player in the role of a shooter is provided with a toy water gun which projects when triggered, a beam of water in the direction in which the gun is aimed. Each player who acts as a target wears a T-shirt or a similar garment having an outer layer lined by an inner layer. The outer layer is formed of a normally opaque white fabric which when a portion thereof is made wet by the beam is then rendered translucent. The inner layer is formed by a red-colored fabric which when an overlying portion of the outer layer is rendered translucent then exhibits a blood-like effect to indicate a hit.

7 Claims, 1 Drawing Sheet

SHOOTER AND FABRIC TARGET WATER GUN GAME

BACKGROUND OF THE INVENTION

1. Field of Invention

This invention relates generally to shooter and target games for children, and more particularly to a game in which a shooter player is provided with a water gun that projects when triggered a water beam in the direction in which the gun is aimed, and in which a target player wears a garment that when struck by the beam and a portion thereof made wet, the wet portion changes color to indicate a hit.

2. Status of Prior Art

A game whose popularity with children is of long standing is one involving a mock battle between "good" and "bad" guys. These good and bad guys may assume many different forms, such as cowboys and indians, cops and robbers, humans and outer-space aliens or whatever other hostile opponents are in vogue with children. But regardless of the character of the opponents, the theme common to these games is that a player provided with a toy weapon assumes the role of a shooter seeking to strike an opposing player who acts as a target. In most such games, each player is both a shooter and target.

In recent years, the usual toy weapon for playing shooter-target games has been a laser-beam gun, the shooter player who holds this gun shooting out a simulated laser beam which he aims in the direction of a target worn by an opposing player. Thus the Scarlari et al. U.S. Pat. No. 4,586,715 discloses a toy laser pistol which includes a flash unit to generate, when the gun is triggered, a burst of high-intensity light. The light is collimated to produce a beam simulating a laser beam. A vest worn by a player who acts as the target is provided with a target area of fluorescent material. This material glows to indicate a hit when a light beam from the toy laser gun strikes the fluorescent target area.

A major drawback of a laser-beam toy pistol is that the light beam projected therefrom when the pistol is triggered is not visible under daylight conditions, thereby making it necessary to generate shooting sounds so that one is then aware that a beam is being projected. And when as in the Scarlari patent, this target is a fluorescent area, this area is ineffective in daylight hours when it is exposed to natural light, for the target is then always "on".

Toy weapons which, when triggered, shoot out a water beam that can be aimed at an opposing player have obvious advantages over laser beam guns. With a water gun a player can in the daytime see the beam of water and also see when this beam strikes an opposing player and where he has hit the player.

But the disadvantage of a water gun, even those currently available which are capable of projecting a water beam over a relatively long distance, is that when the beam strikes a player there is nothing to then indicate that the target has been hit or where it has been hit other than the fact that the target is wet in the region struck by the water beam.

Even if the target player is wearing a colored garment and a portion thereon is struck by a water beam, the wet portion of the colored garment is not very different in appearance from the adjacent dry portion, and the fact that the target has been hit is not clearly evident.

SUMMARY OF INVENTION

In view of the foregoing, the main object of this invention is to provide a shooter and target game for children in which a player acting as a shooter caries a water gun and the player acting as a target wears a garment which when struck by a beam of water projected from the gun then changes color in that portion of the garment that is rendered wet, thereby indicating a hit.

A significant feature of the invention is that the garment includes several hit zones whose placement determines the credit points to be accorded a hit when a given zone is made wet. Thus a zone in the region of the heart is given a higher number of points than a naval zone or a chest zone.

More particularly, an object of this invention is to provide a target player with a T-shirt which when dry is white and opaque and which when a portion of the shirt worn by the target player is made wet by a water beam from the gun of the shooter player, the wet portion then turns the color of blood to indicate a hit.

Briefly stated, these objects are attained by a mock battle game for children in which each player in the role of a shooter is provided with a water gun which projects when triggered, a beam of water in the direction in which the gun is aimed. Each player who acts as target wears a T-shirt or a similar garment having an outer layer lined by an inner layer.

The outer layer is formed of a normally opaque white fabric which when a portion thereof is made wet by the beam is then rendered translucent. The inner layer is formed by a red-colored fabric which when an overlying portion of the outer layer is rendered translucent then exhibits a blood-like effect to indicate a hit.

BRIEF DESCRIPTION OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
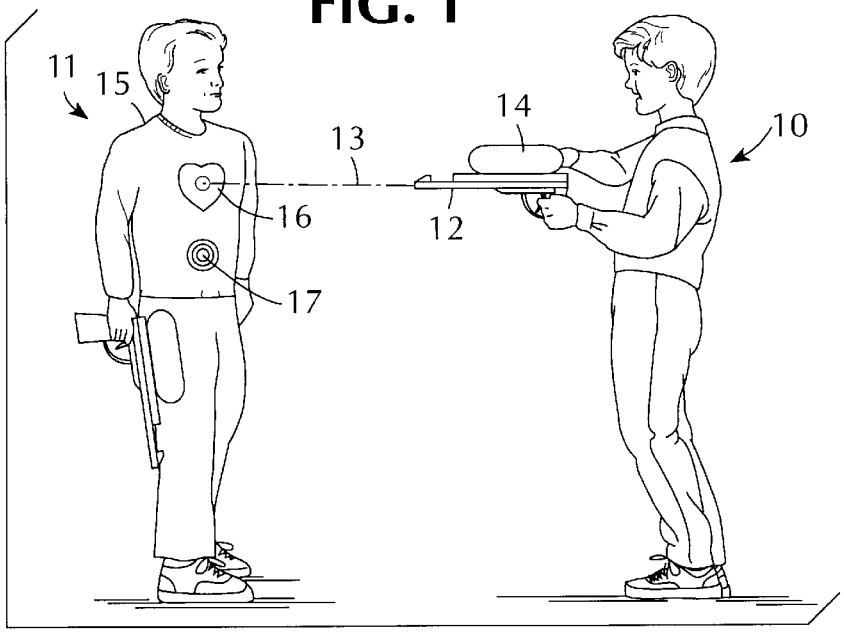
FIG. 1 illustrates a shooter-player and a target-player participating in a game in accordance with the invention.

Referring now to FIG. 1, shown therein are two players 10 and 11 who are participating in a mock battle game in accordance with the invention, player 10 acting as a shooter and player 11 as a target.

Shooter-player 10 is provided with a water gun 12 which when triggered shoots out a pressurized water beam 13 that is projected in the direction in which the gun is aimed by player 10. Any commercially-available toy water gun is useable to play the game, preferably one capable of shooting out a beam for a relatively long distance and including a replenishable bottled reservoir of water 14 supplying water to the pump of the gun. In practice, all players should be equipped with identical water guns and therefore be on an equal footing in the game.

Target player 11 wears a T-shirt 15 or a long-sleeve garment of the same material which when struck by water beam 13 then turns color in that portion of the garment made wet by the impinging beam to indicate a hit. In practice, each player on the game is both a shooter and a target, for each player not only wears a T-shirt 15 but he also carries a water gun 12.

Thus every player in the game who seeks to shoot an opposing player is subject to attack by that player. In any game there may be many more than two players, the object of the game being for each player to shoot whatever other players he can and in doing so to score enough points to strike out the players he has hit. The winner of a game in which there are say five participating players in a limited field, such as a children's playground, is the surviving player who has not been struck out in the course of the game.

Figure 2:
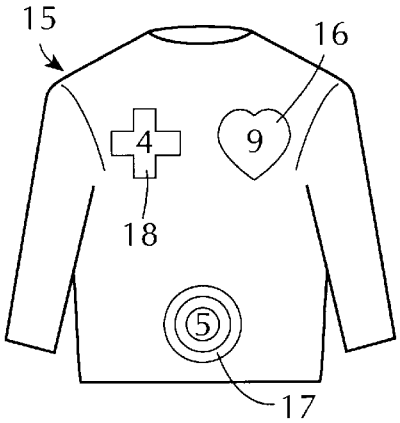
FIG. 2 is a front view of the T-shirt worn by the target player.
Figure 3:
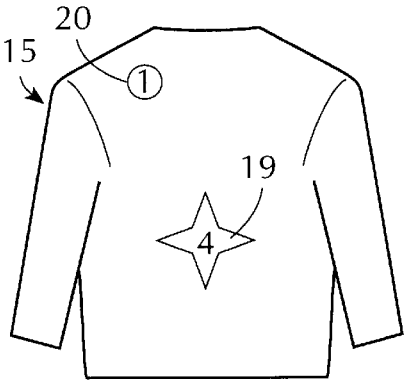
FIG. 3 is a rear view of this T-shirt.

FIGS. 2 and 3 illustrate the manner in which hits are scored on the front and rear of T-shirt 15. Printed on the front of the T-shirt, as shown in FIG. 2 are three target zones having different point values. Zone 16 which is heart shaped and placed adjacent the region of the heart, produces a score of 9 points when hit. It takes a total of 9 points to strike out a player; hence when heart target zone 16 is made wet by a water beam impinging thereon, this strikes out the target player who is then excluded from the game.

Also in the front of T-shirt 15 is a bull's eye zone 17 adjacent the navel of the player which when hit scores 5 points. And in the chest region there is a cross-shaped target zone 18 which when hit scores 4 points. Hence it is only by hitting both zones 17 and 18 that one attains a total score of 9 points to strike out the target player and exclude him from the game.

On the rear of the T-shirt, as shown in FIG. 3, is a single star-shaped zone 19 having a 4 points score. Hence to strike out a player, one must hit both 4 point zone 19 on the rear of the shirt and 5 point zone 17 on the front. Should one hit both zone 19 and zone 18, the total points then are 8, one short of a strike out. On the rear in the shoulder region is a round zone 20 having a one point score. Hence one can strike out a player by hitting one point zone 20, four point zone 19 and four point zone 18.

Figure 4:
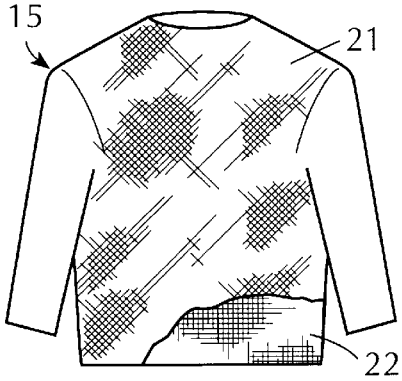
FIG. 4 is a cut-away view of the T-shirt exposing the inner layer thereof which lines the outer layer.

As shown in FIG. 4, T-shirt 15 is formed from an outer layer 21 and an inner layer 20 fully lining the outer layer and sewn or otherwise joined thereto. Outer layer 21 is fabricated of a tightly-woven fabric formed of cotton, or synthetic fibers or a mixture of cotton and synthetic fibers that is white in color and normally opaque. The zones printed on outer layer 21 are outlined in black ink. The nature of the fabric of outer layer 21 is such that when made wet by a beam of water impinging thereon, only that portion of the fabric which is soaked is rendered translucent, and one an then see through the wet portion, thereby exposing to view the corresponding portion of inner layer 22 lining the outer layer.

Figure 5:
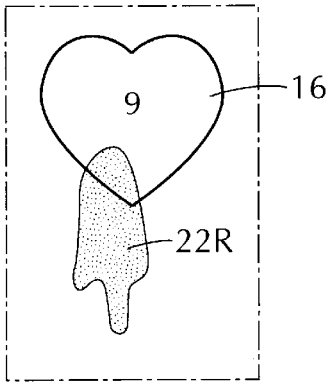
FIG. 5 shows a wet portion of the shirt simulating blood.

Inner layer 22 is fabricated of rayon or of a similar shiny material having a blood red color. If therefore the heart-shaped zone 16 on outer layer 21 is struck and made wet, then one will see the blood red inner liner under the wet portion of zone 16. As shown in FIG. 5, what is wet is not confined within zone 16, for even should the water beam strike the center of this zone, the water will drip down below the zone. As a consequence, what appears to be blood produced by the hit will seem to be bleeding below the hit point to provide a realistic effect.

Should the T-shirt be struck outside the boundaries of a target zone, say below cross-shaped zone 18, though a blood-like effect will then be produced in the wet region of the shirt, it will not be scored. In order therefore to strike out a player, the water beam from the water fun must impinge on a point within the boundaries of a target zone on the shirt.

When the wet portion of the outer layer dries out, it is again in condition for use in a subsequent game. The advantage of a composite or a synthetic fiber rather than a pure cotton fabric is that these dry out more quickly.

While there has been shown and described a preferred embodiment of a shooter and target water gun game in accordance with the invention, it will be appreciated that many changes and modifications may be made therein without, however, departing from the essential spirit thereof.

I claim:

1. A mock battle game for children comprising:

A. a shooter-player provided with a water gun which projects when triggered by the player a beam of water in a direction in which the gun is aimed; and B. a target-player wearing a fabric garment which when any portion thereof is made wet by the beam impinging thereon, the wet portion then changes color to indicate a hit, said fabric garment being provided with a normally opaque outer layer having a distinctive color, and an inner layer having a different distinctive color, said normally opaque outer layer being rendered translucent when wet, whereby when a portion of the outer layer is made wet by the water beam impinging thereon and rendered translucent, the color of a corresponding portion of the inner layer is exposed which contrasts with the color of the outer layer surrounding the wet portion thereof.

2. A game as set forth in claim 1, in which the gun includes a water reservoir to supply water to a pump of the gun.

3. A game as set forth in claim 1, in which the outer layer is tightly woven of cotton or a mixture of cotton and synthetic fibers.

4. A game as set forth in claim 1, in which the inner layer has the color of blood.

5. A game as set forth in claim 4, in which the inner layer is fabricated or rayon.

6. A game as set forth in claim 1, in which printed on the outer layer are a plurality of target zones, each having a different shape.

7. A game as set forth in claim 1, in which the color of the outer layer is white and the color of the inner layer is red.

* * * * *